US011629515B2

(12) United States Patent
Watanabe et al.

(10) Patent No.: US 11,629,515 B2
(45) Date of Patent: Apr. 18, 2023

(54) BOOTH

(71) Applicant: FUJIFILM Business Innovation Corp., Tokyo (JP)

(72) Inventors: Shu Watanabe, Kanagawa (JP); Kunichi Yamashita, Kanagawa (JP); Akihide Kawamura, Kanagawa (JP); Masamichi Kimura, Kanagawa (JP); Shigenaga Fujimura, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/396,787

(22) Filed: Aug. 9, 2021

(65) Prior Publication Data

US 2022/0243487 A1 Aug. 4, 2022

(30) Foreign Application Priority Data

Feb. 3, 2021 (JP) ..... JP2021-015379

(51) Int. Cl.
*E04H 1/12* (2006.01)
*E04B 1/82* (2006.01)
*A47B 3/14* (2006.01)

(52) U.S. Cl.
CPC ..... *E04H 1/125* (2013.01); *A47B 3/14* (2013.01); *E04B 1/8218* (2013.01); *A47B 2200/0072* (2013.01); *A47B 2200/06* (2013.01)

(58) Field of Classification Search
CPC ..... E04H 1/125; E04B 1/8218; E04B 2/7403
See application file for complete search history.

(56) References Cited

U.S. PATENT DOCUMENTS 3,711,878 A * 1/1973 George ..... A47C 17/38 5/133
5,996,669 A * 12/1999 Miller ..... E06B 9/58 160/183
2006/0254159 A1* 11/2006 Trautman ..... E04H 15/008 52/64
2014/0116870 A1* 5/2014 Kamen ..... E04H 3/08 202/83
2018/0274255 A1* 9/2018 El-Wakeel ..... E04H 1/1222
2019/0177993 A1* 6/2019 Shell ..... E04H 1/125
2020/0018060 A1* 1/2020 Watanabe ..... E04H 1/1205
2020/0095787 A1* 3/2020 Van Aukee ..... E04B 1/34861
2020/0347626 A1* 11/2020 Petty ..... E04B 1/34357

FOREIGN PATENT DOCUMENTS

DE 202019105697 U1 * 12/2019
GB 2501538 A * 10/2013 ..... A47B 83/001
JP 2001104054 4/2001
JP 2003074138 3/2003
JP 2004150255 5/2004
WO WO-0190511 A1 * 11/2001 ..... E04B 1/8218

* cited by examiner

*Primary Examiner* — Christine T Cajilig
(74) *Attorney, Agent, or Firm* — JCIPRNET

(57) ABSTRACT

A booth that has an opening through which a user enters and exits the booth and a desk and a chair installed in a space surrounded by a floor and a side wall, the booth includes a movable sound insulation member that is installable to enclose the user in a case where the user is below a top portion of the booth while being in the booth.

18 Claims, 16 Drawing Sheets

BOOTH

CROSS-REFERENCE TO RELATED APPLICATIONS

This application is based on and claims priority under 35 USC 119 from Japanese Patent Application No. 2021-015379 filed Feb. 3, 2021.

BACKGROUND

(i) Technical Field

The present invention relates to a booth.

(ii) Related Art

A private room box composed of a top panel, a floor panel, and four wall panels on front, back, left, and right sides is known (JP2004-150255A). Each panel is composed of a lightweight panel, the panels are bonded to each other by means of bolts and nuts so that the private room box can be freely assembled and disassembled, and at least a table portion and a one-person chair corresponding to the table portion are provided in the private room box.

A partitioning device including a main body of which three quadrangular panels are consecutively connected to each other in a channel-shaped steel shape of which opening ends are widely open and a door body that is composed of at least two quadrangular panels foldably connected to each other and of which one end side on one side is rotatably connected to an opening end side on the one side of the main body is also known (JP2003-74138A).

SUMMARY

Aspects of non-limiting embodiments of the present disclosure relate to a booth that can be easily installed in a space and can improve the work efficiency of a user.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a booth that has an opening through which a user enters and exits the booth and a desk and a chair installed in a space surrounded by a floor and a side wall, the booth including a movable sound insulation member that is installable to enclose the user in a case where the user is below a top portion of the booth while being in the booth.

BRIEF DESCRIPTION OF THE DRAWINGS

Exemplary embodiment(s) of the present invention will be described in detail based on the following figures, wherein.

DETAILED DESCRIPTION

Next, the present invention will be more specifically described with reference to the drawings while using exemplary embodiments and a specific example as follows. However, the present invention is not limited to the exemplary embodiments and the specific example.

In addition, note that, in the following description made by using the drawings, the drawings are schematic, the ratio between dimensions or the like is different from the actual ratio, and members other than members that need to be illustrated for description have been appropriately omitted for the sake of easy understanding.

(1) Overall Configuration of Booth

First Exemplary Embodiment

Figure 1:
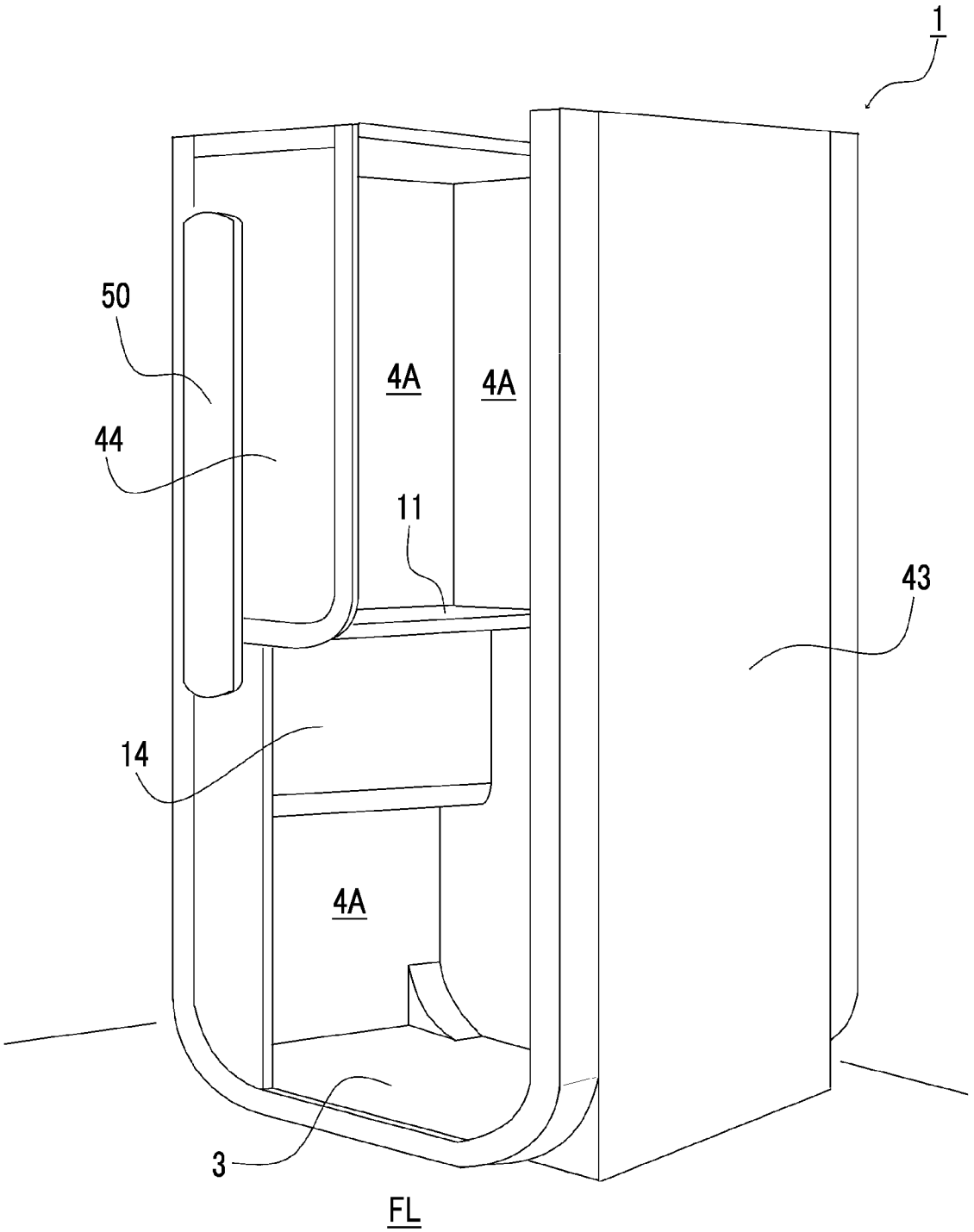
FIG. 1 is an overall perspective view showing a booth according to the present exemplary embodiment with a viewpoint on a right surface.
Figure 2:
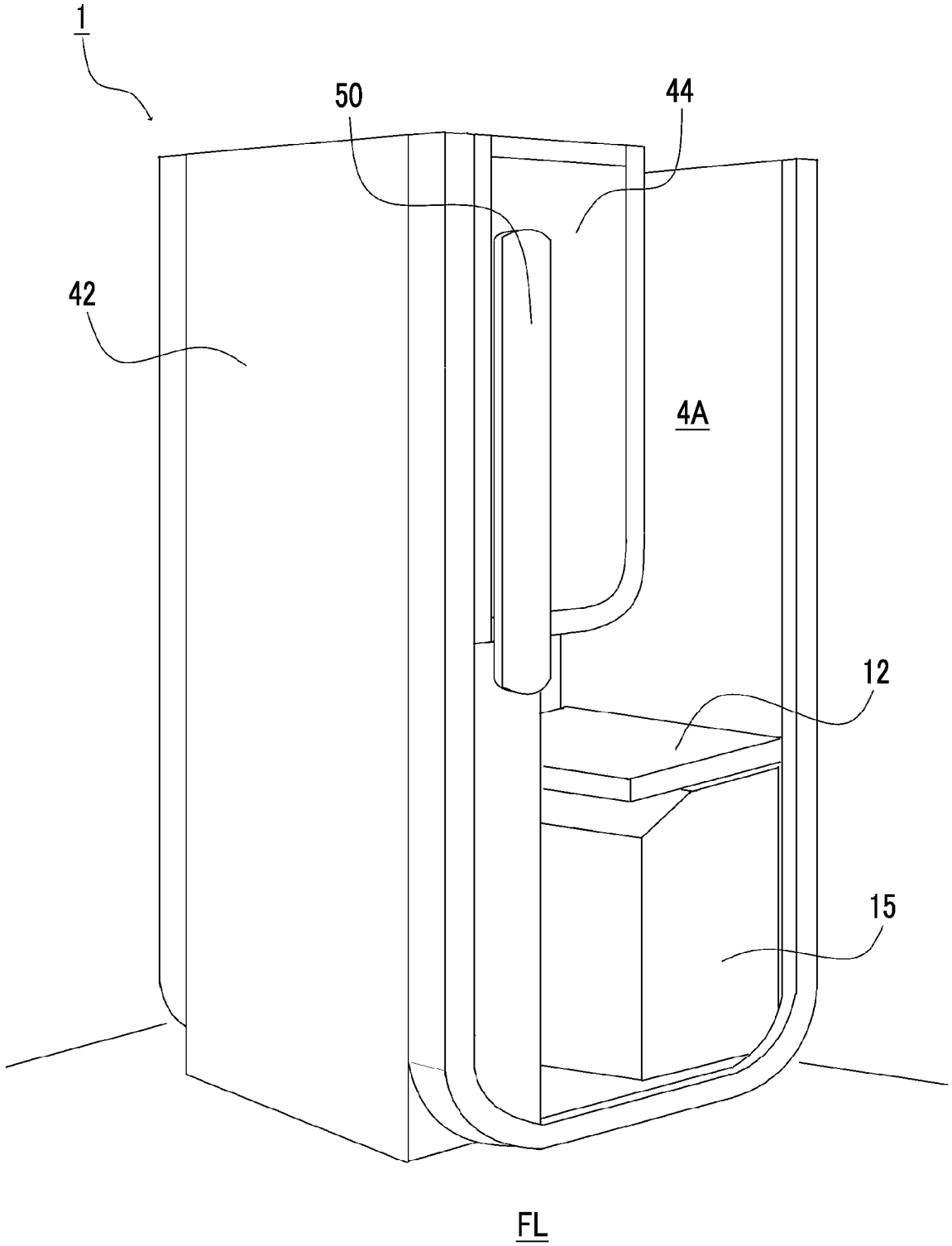
FIG. 2 is an overall perspective view showing the booth according to the present exemplary embodiment with a viewpoint on a left surface.
Figure 3B:
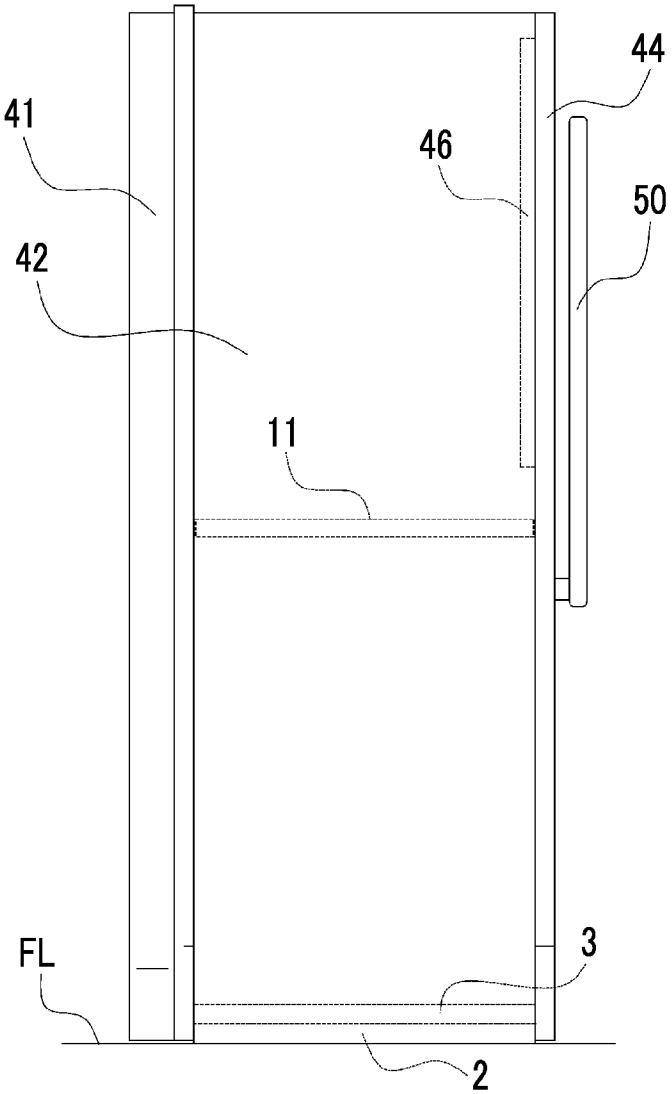
FIG. 3A is a front view with a viewpoint on an opening portion side of the booth and FIG. 3B is a side view of a second panel side.
Figure 3A:
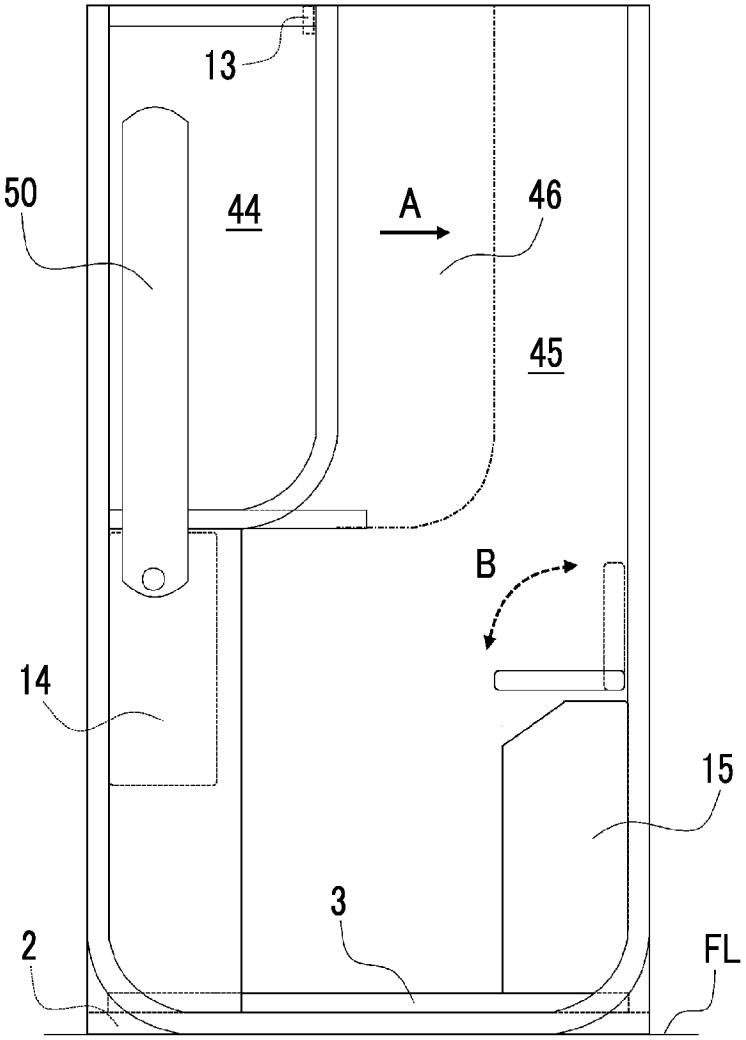
Figure 4:
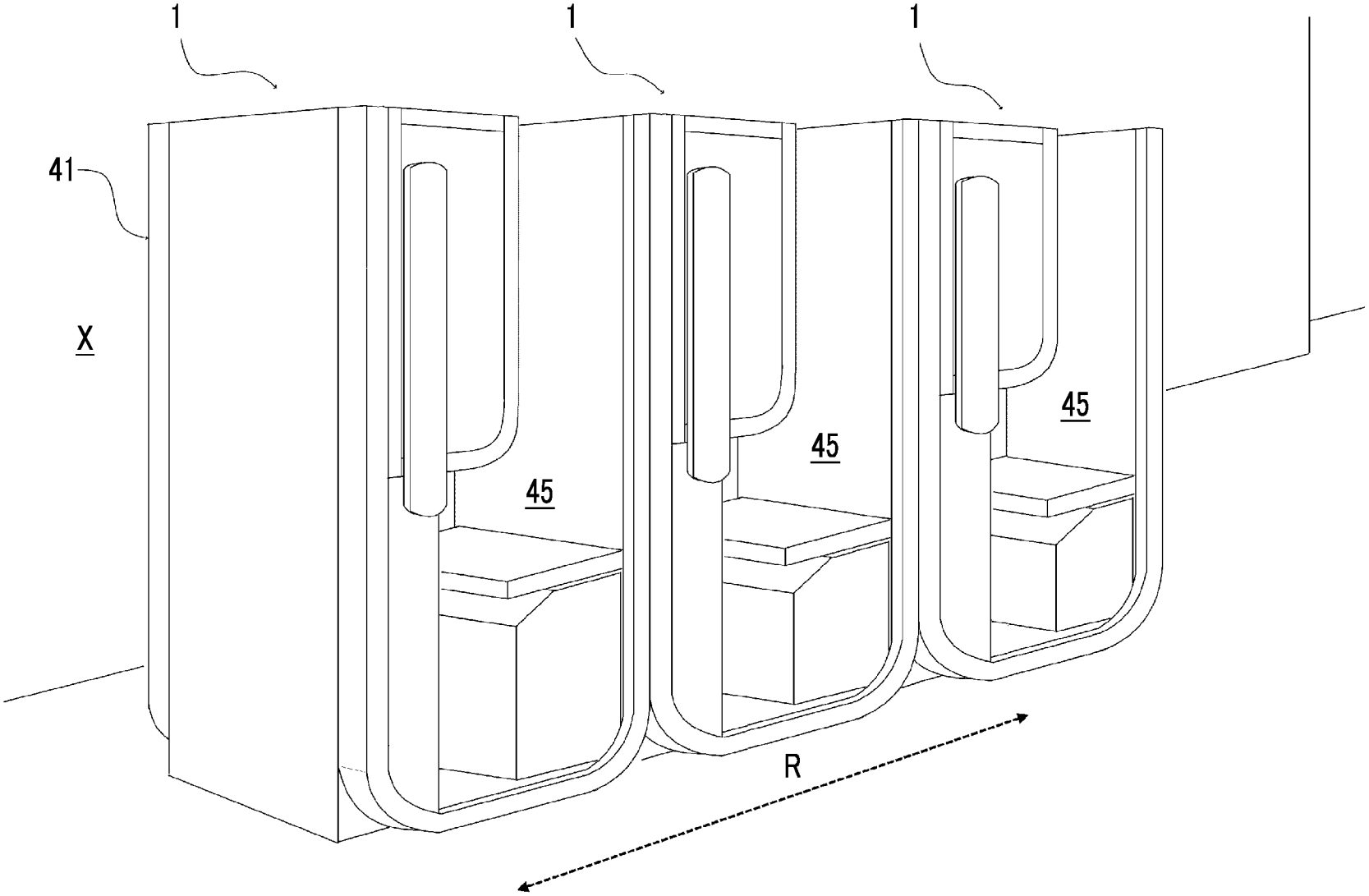
FIG. 4 is a view showing an installation example of the booth.

FIG. 1 is an overall perspective view showing a booth 1 according to the present exemplary embodiment with a viewpoint on a right surface, FIG. 2 is an overall perspective view showing the booth 1 according to the present exemplary embodiment with a viewpoint on a left surface, FIG. 3A is a front view with a viewpoint on an opening portion 45 side of the booth 1, FIG. 3B is a side view of a second panel side, and FIG. 4 is a view showing an installation example of the booth 1. Hereinafter, the overall configuration of the booth 1 will be described with reference to the drawings.

As shown in FIGS. 1 and 2, the booth 1 has a box shape as a whole and a desk 11, a chair 12, a light 13 (shown in FIG. 3A), an electrical component box 14, and a power source 15 are installed in the booth 1. In a space formed in the booth 1, a user can sit on the chair 12 and sit at the desk 11 to perform various jobs such as work or study or receive online services via an electric telecommunication line.

The booth 1 includes a base portion 2 provided on an installation surface FL, a floor plate portion 3 provided on the base portion 2, side wall panels 4 erected on the base portion 2, a gate bar 50 that is opened and closed such that the space becomes enterable for the user, and a movable sound insulation member 60 (shown in FIG. 5) that can be installed to enclose the user.

The base portion 2 is obtained by bonding four beam members to each other to form a rectangular shape corresponding to the shape of the bottom of the booth 1, and consists of, for example, rectangular steel pipes.

The floor plate portion 3 is provided to protrude inside the base portion 2, and for example, a floor mat is stacked on a structural plywood which is a wooden plate material.

The side wall panels 4 consist of a first side wall panel 41 (shown in FIG. 3B) constituting a back wall, a second side wall panel 42 and a third side wall panel 43 constituting left and right walls, and a fourth side wall panel 44 constituting a front wall. Sound absorption panels 4A are provided on inner sides of the first side wall panel 41, the second side wall panel 42, and the third side wall panel 43 (inside space). Each sound absorption panel 4A consists of a frame body (not shown), a fiber sheet attached to the frame body, and the like, and has an action of absorbing sound in the space.

As shown in FIG. 3A, the fourth side wall panel 44 is provided on the second side wall panel 42 side at a front surface of the booth 1 such that the fourth side wall panel 44 covers a region higher than the desk 11 on the front side of the booth 1. Accordingly, the opening portion 45 serving as an entrance and an exit is formed in the front surface of the booth 1.

A door 46 that covers a portion of the opening portion 45 is mounted on the back side (space side) of the fourth side wall panel 44. In the present exemplary embodiment, the door 46 is a sliding door and the user may pull out the door 46 in the space (as shown with arrow A in FIG. 3A) to make it difficult to see a job in the space from the outside.

In addition, in the opening portion 45, the gate bar 50 that is opened and closed such that the user can enter the space is disposed. An electromagnetic lock (refer to FIG. 9) as a locking unit that can be unlocked by means of an unlocking key signal is attached to the gate bar 50 and the gate bar 50 is unlocked so that the opening portion 45 is opened in a case where the user performs an operation of placing a terminal, with which a reservation for use of the booth 1 has been made, in front of the electromagnetic lock.

The booth 1 is provided with the movable sound insulation member 60 that may be installed to enclose the user in a case where the user is below the top portion of the booth 1 (refer to FIG. 5). The sound insulation member 60 is stored in a storage region S (see FIGS. 6A to 6C) on the first side wall panel 41 side and is movable to a closing position, at which the sound insulation member 60 covers a portion of the opening portion 45, by being pulled out from the storage region S and moved along guide grooves G each of which is provided in an arch shape protruding to an upper side of the space. The user may suppress sound leakage from the booth 1 and make the inside of the booth 1 quiet by moving the sound insulation member 60 to the closing position.

The desk 11 is disposed on the floor plate portion 3 to be in contact with the second side wall panel 42 which is on a left side as seen from the opening portion 45. Above the desk 11, a plug socket and a switch or the like (not shown) of the light 13 are disposed along the second side wall panel 42 and the light 13 is disposed to face the second side wall panel 42 at the top portion. The electrical component box 14 is disposed below the desk 11. The electrical component box 14 receives power from the power source 15 and controls the operation of a device in the booth 1.

The chair 12 is disposed on the floor plate portion 3 to be in contact with the third side wall panel 43 that is on a right side as seen from the opening portion 45. A seat surface of the chair 12 is foldable (as shown with arrow B in FIG. 3A) and the seat surface becomes sittable by being unfolded to have a length and a height such that a rear part of the femoral region of the user is not pressed.

Below the chair 12, the power source 15 for supply of power to a device in the booth 1 such as the light 13 and the electrical component box 14 is disposed. In the present exemplary embodiment, the power source 15 is a storage battery and the booth 1 can be installed even in a place where there is no power supply port.

The outer periphery of the power source 15 is covered with a heat insulating member so that overheating of the outer periphery of the power source 15 is suppressed. In addition, a fan (not shown), which is an example of a cooling unit cooling the power source 15, is installed to suppress overheating of the power source 15. In addition, in the vicinity of the power source 15, a thermistor (not shown) is provided as a detection unit detecting the heat of the power source 15. Furthermore, for example, it is preferable that a fire extinguisher (not shown) is disposed in the vicinity of the power source 15 as a fire extinguishing unit.

The booth 1 configured as described above is configured such that the booth 1 can be assembled at a factory or the like, carried on a cargo bed of a truck or the like, and installed on the installation surface FL at a predetermined installation place. Examples of the installation place include an internal corner portion of a building frame and a place in front of a wall surface, which are examples of an external space where passersby and the user of the booth 1 coexist. In addition, the installation place is not limited to an internal corner portion of a building frame or a place in front of a wall surface and can be freely disposed in a concourse space, an office building passage, a trade fair hall, a commercial space, a convenience store, and the like.

Specifically, as shown in FIG. 4, installation with respect to a wall surface X of a building frame is performed with the first side wall panel 41 facing the wall surface X. In a case where the installation is performed in such a manner, the opening portion 45 of the booth 1 faces a passage R side, the user can easily enter and exit the booth 1, and the booth 1 can be disposed such that the booth 1 is restrained from protruding toward a passage side and the booth 1 does not inhibit the passage of passersby.

(2) Configuration of Booth (2.1) Sound Insulation Member

Figure 5:
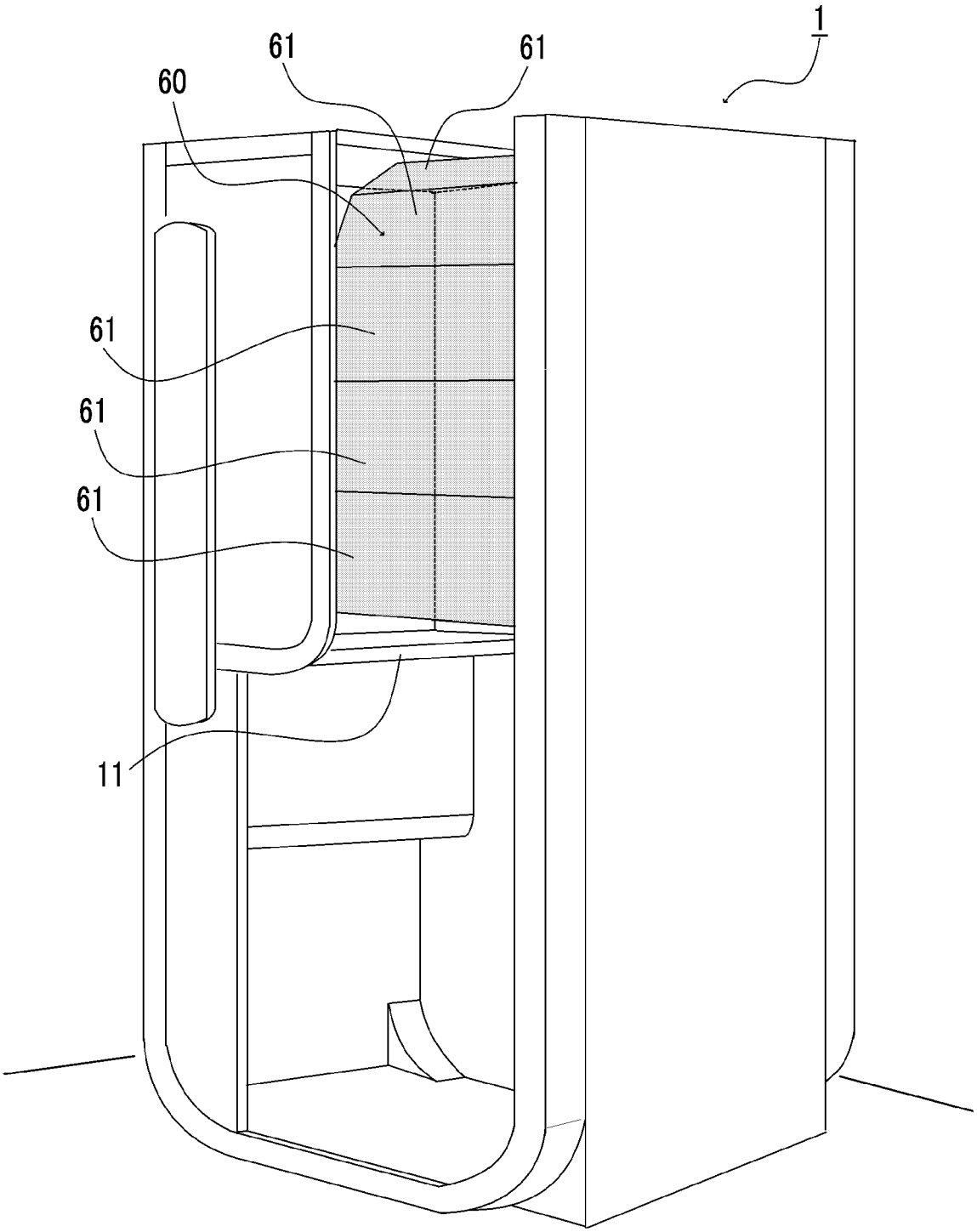
FIG. 5 is a perspective view showing the booth with a sound insulation member moved to a closing position.
Figure 6C:
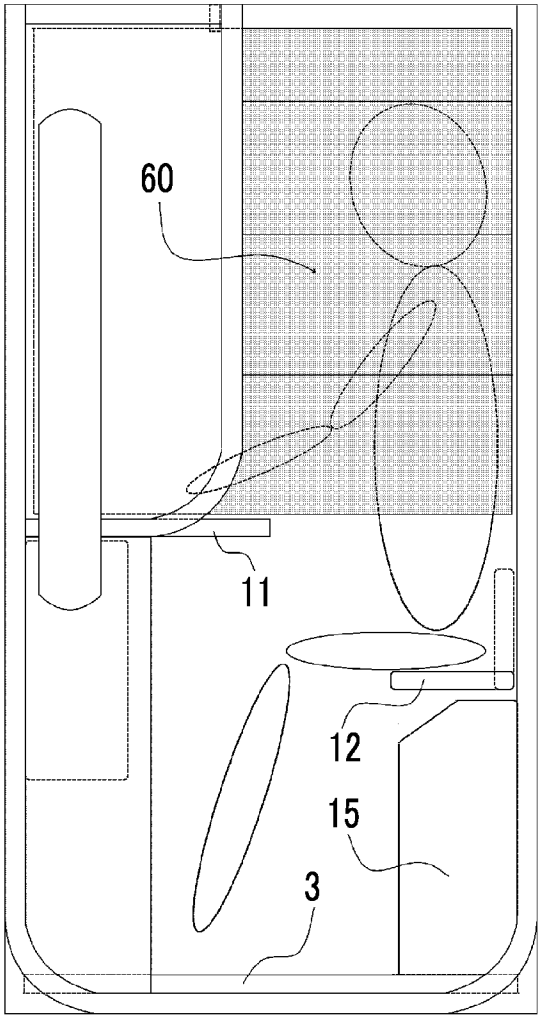
FIG. 6C is a front view showing a state where the sound insulation member is positioned at the closing position in relation to a user in a space.
Figure 6B:
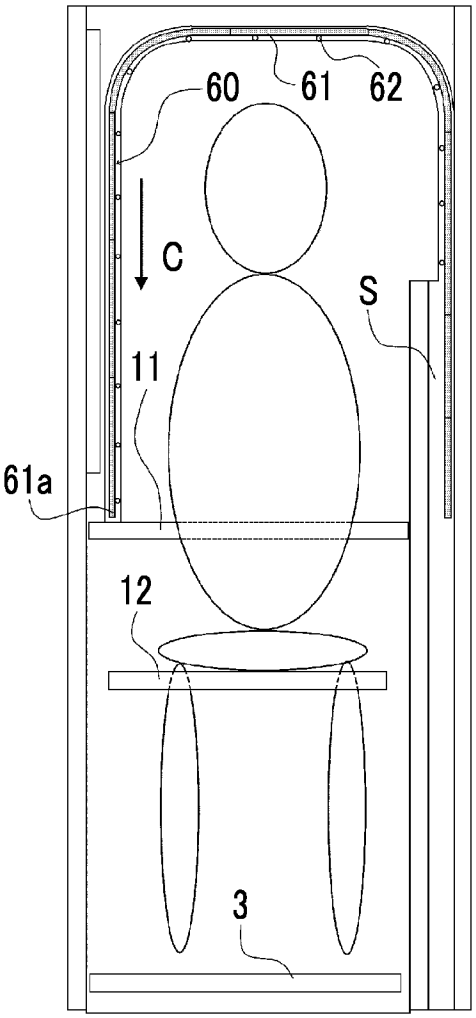
FIG. 6B is a schematic cross-sectional view showing a state where the sound insulation member is positioned at the closing position.
Figure 6A:
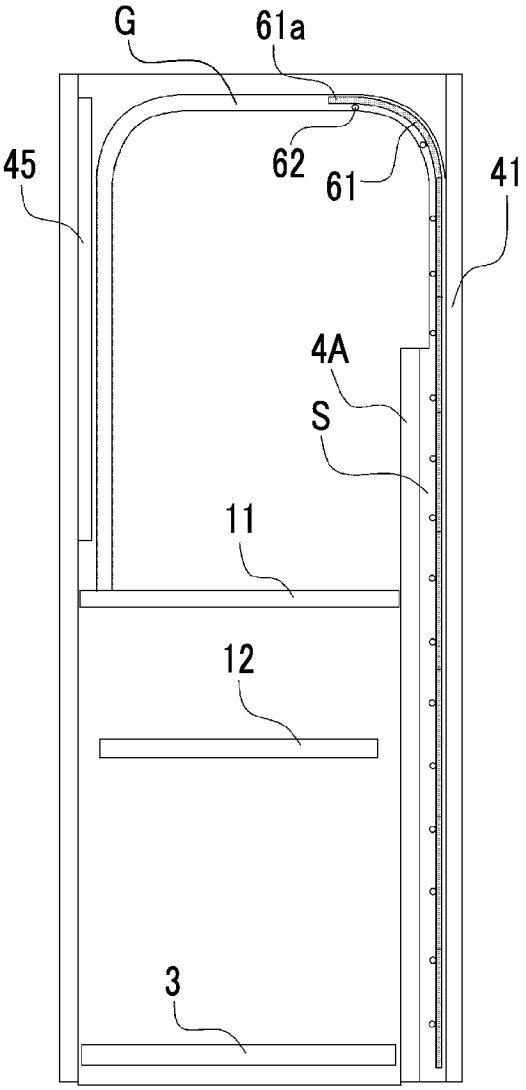
FIG. 6A is a schematic cross-sectional view showing a state where the sound insulation member is positioned at an opening position.

FIG. 5 is a perspective view showing the booth 1 with the sound insulation member 60 moved to the closing position, FIG. 6A is a schematic cross-sectional view showing a state where the sound insulation member 60 is positioned at an opening position, FIG. 6B is a schematic cross-sectional view showing a state where the sound insulation member 60 is positioned at the closing position, and FIG. 6C is a front view showing a state where the sound insulation member 60 is positioned at the closing position in relation to the user in the space.

As shown in FIG. 5, the booth 1 according to the present exemplary embodiment includes the movable sound insulation member 60 that can be installed to enclose the user in a case where the user is below the top portion of the booth 1. The sound insulation member 60 consists of a plurality of unit panels 61, each of which is transparent as a whole (portion represented by halftone in FIG. 5 is transparent) and which are foldably connected to each other, and as shown in FIG. 6A, the sound insulation member 60 is stored in the storage region S defined by the first side wall panel 41 and the sound absorption panel 4A provided at an inner surface of the space in a case where the sound insulation member 60 is at the opening position at which an upper side of the space in the booth 1 is opened.

The material of the unit panels 61 constituting the sound insulation member 60 is not particularly limited as long as the material is transparent or translucent and has a certain soundproofing performance. In the present exemplary embodiment, a soundproof transparent sheet that has a thickness of about 2 mm and of which the core material is formed of polyester and the surface is formed of a fire-resistant PVC film is used. Since the unit panels 61 are transparent, daylight may be provided into the space and the space may be brightened.

As shown in FIG. 6A, the guide grooves G, each of which is provided in the arch shape protruding to the upper side of the space, are formed on inner surface sides of the second side wall panel 42 and the third side wall panel 43. A plurality of rotary bodies 62 are rotatably provided on the unit panels 61 and the sound insulation member 60 is movable to the closing position, at which the sound insulation member 60 covers a portion of the opening portion 45, by being pulled out from the storage region S and moved along the guide grooves G.

In a case where the sound insulation member 60 is to be installed, the sound insulation member 60 is installed such that the sound insulation member 60 encloses the user at a region that is on the upper side of the opening portion 45 and is higher than the desk 11 as schematically shown in FIG. 6C in a case where one end 61*a* of the unit panel 61 is pulled out and moved to the closing position along the guide grooves G (refer to arrow C in FIG. 6B) as shown in FIG. 6B in a state where the user is present below the top portion of the booth 1.

In the space of the booth 1, the sound absorption panels 4A are disposed on the inner surface sides of the side wall panels 4 and a region higher than the desk 11 is covered with the sound insulation member 60 having a certain soundproofing performance. Therefore, it is difficult to hear an undesired sound in the space and the space is made quiet. Accordingly, it is not necessary to speak loudly and sound leakage from the booth 1 may be suppressed.

Modification Example

Figure 7:
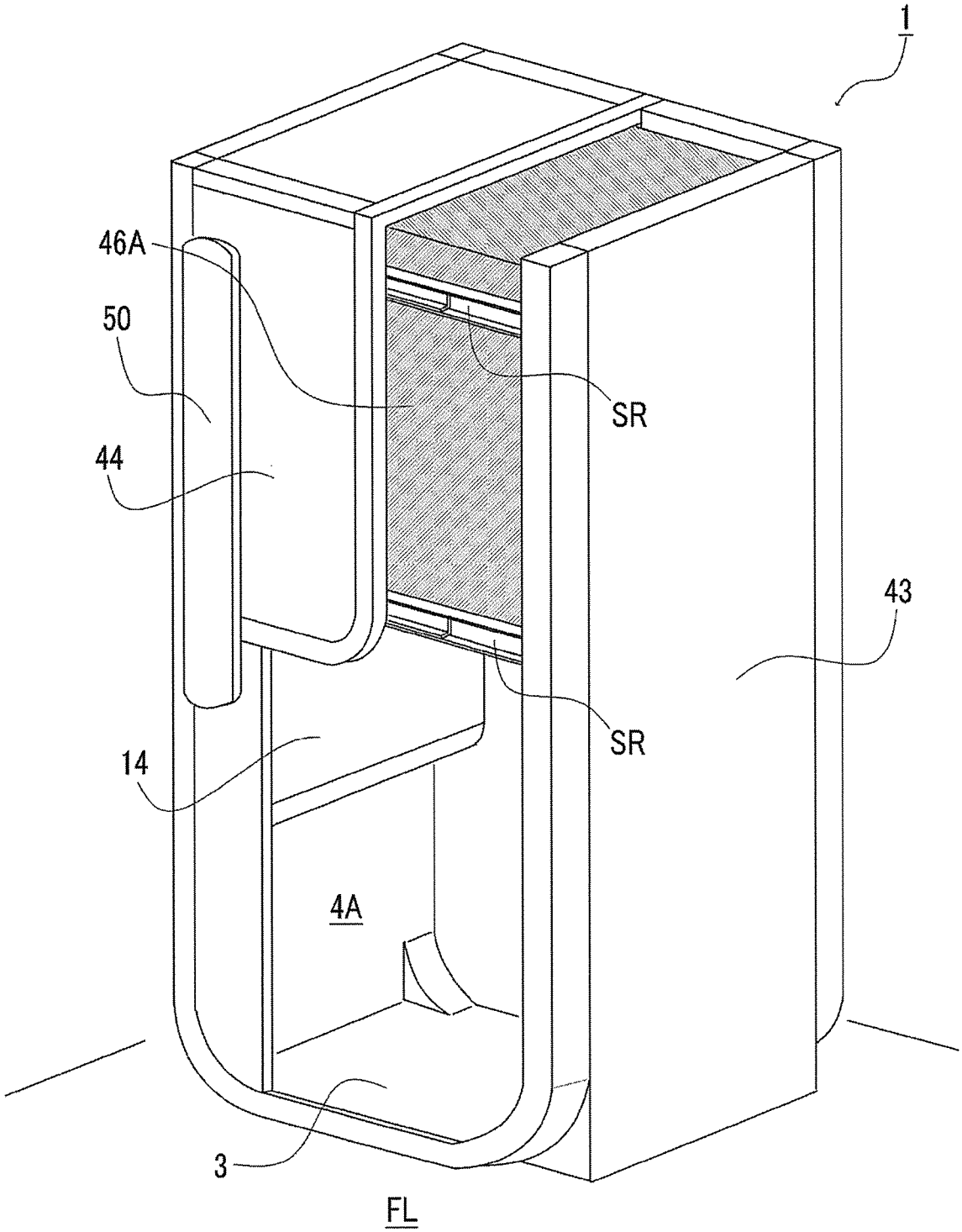
FIG. 7 is an overall perspective view showing the booth including a door according to a modification example with a viewpoint on a right surface side.
Figure 8B:
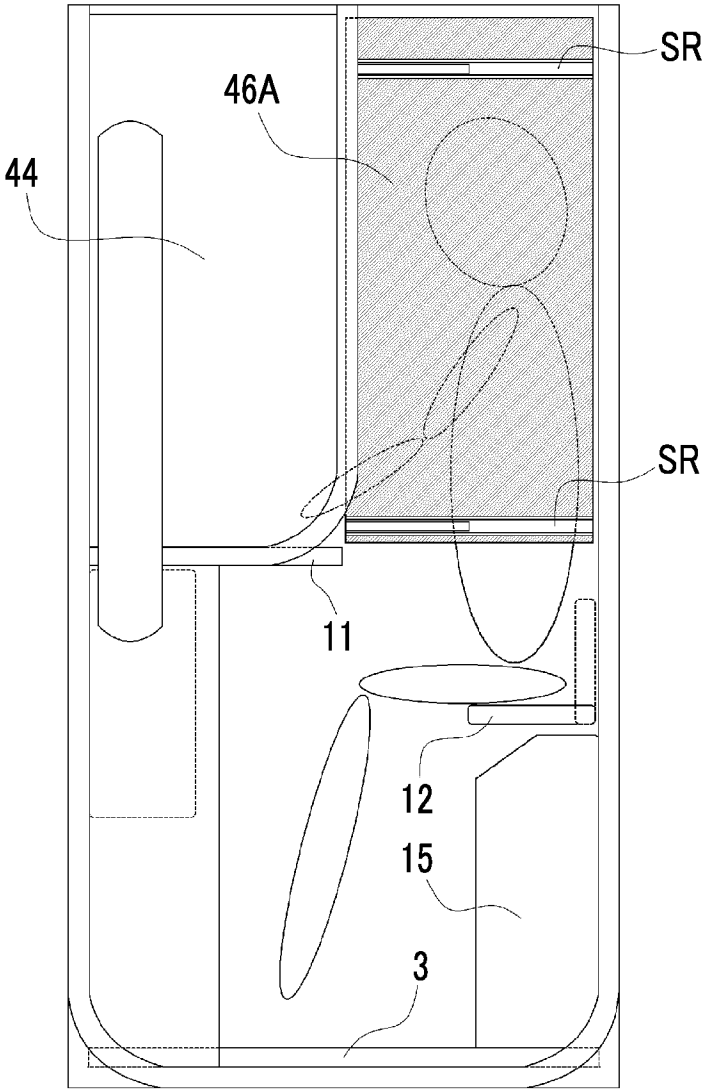
FIG. 8A is a schematic cross-sectional view showing the structure of the door according to the modification example and FIG. 8B is a front view showing a state where the door according to the modification example is positioned at a closing position in relation to the user in the space.
Figure 8A:
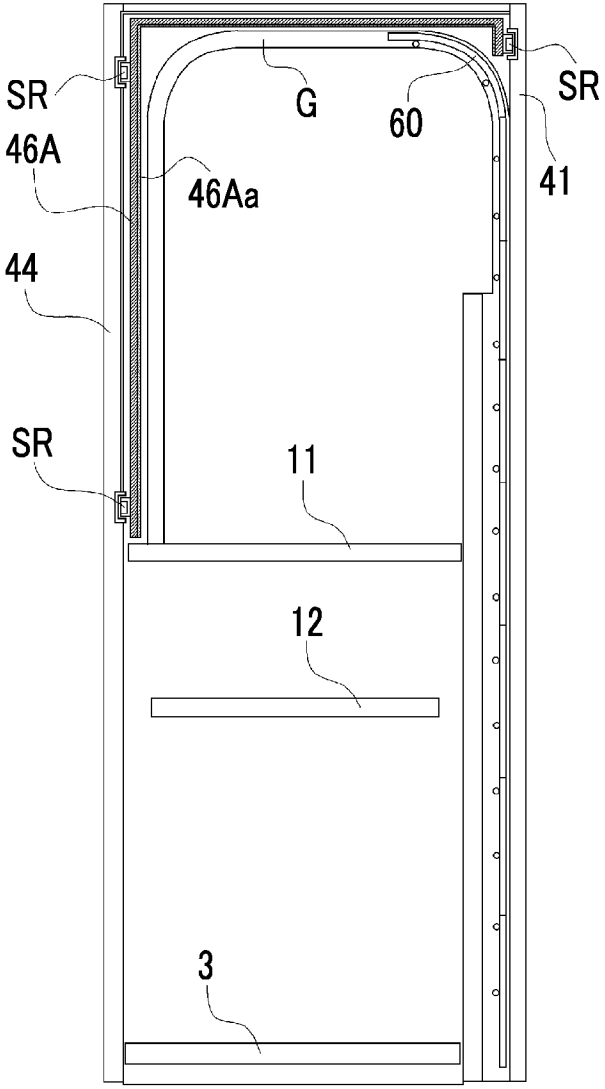

FIG. 7 is an overall perspective view showing the booth 1 including a door 46A according to a modification example with a viewpoint on a right surface side, FIG. 8A is a schematic cross-sectional view showing the structure of the door 46A according to the modification example, and FIG. 8B is a front view showing a state where the door 46A according to the modification example is positioned at a closing position in relation to the user in the space.

The door 46A (hatched in drawings) according to the modification example is a member bent in an inverted L shape as seen in a cross-sectional view so as to cover a front portion of the opening portion 45 that is above the desk 11 and an upper portion of the space.

As shown in FIG. 7 and FIGS. 8A and 8B, the door 46A is slidably and movably supported by the fourth side wall panel 44 and the first side wall panel 41 via slide rails SR.

A sound insulation sheet 46Aa is attached to an inner surface of the door 46A. Similarly to the sound insulation member 60, the sound insulation sheet 46Aa is a sheet material having a certain soundproofing performance and a soundproof sheet that has a thickness of about 2 mm and of which the core material is formed of polyester and the surface is formed of a fire-resistant PVC film is used as the sound insulation sheet 46Aa.

As shown in FIG. 8B, the inside of the space may be made difficult to see from the outside, sound leakage from the booth 1 may be suppressed, and the inside of the booth 1 may be made quiet in a case where the door 46A in a state of being accommodated inside the fourth side wall panel 44 is slid and moved to cover upper portions of the opening portion 45 and the space. Particularly, sound leakage from the booth 1 may be further suppressed and the inside of the booth 1 may be made quiet in a case where the door 46A is closed with the sound insulation member 60 moved to the closing position.

Figure 9:
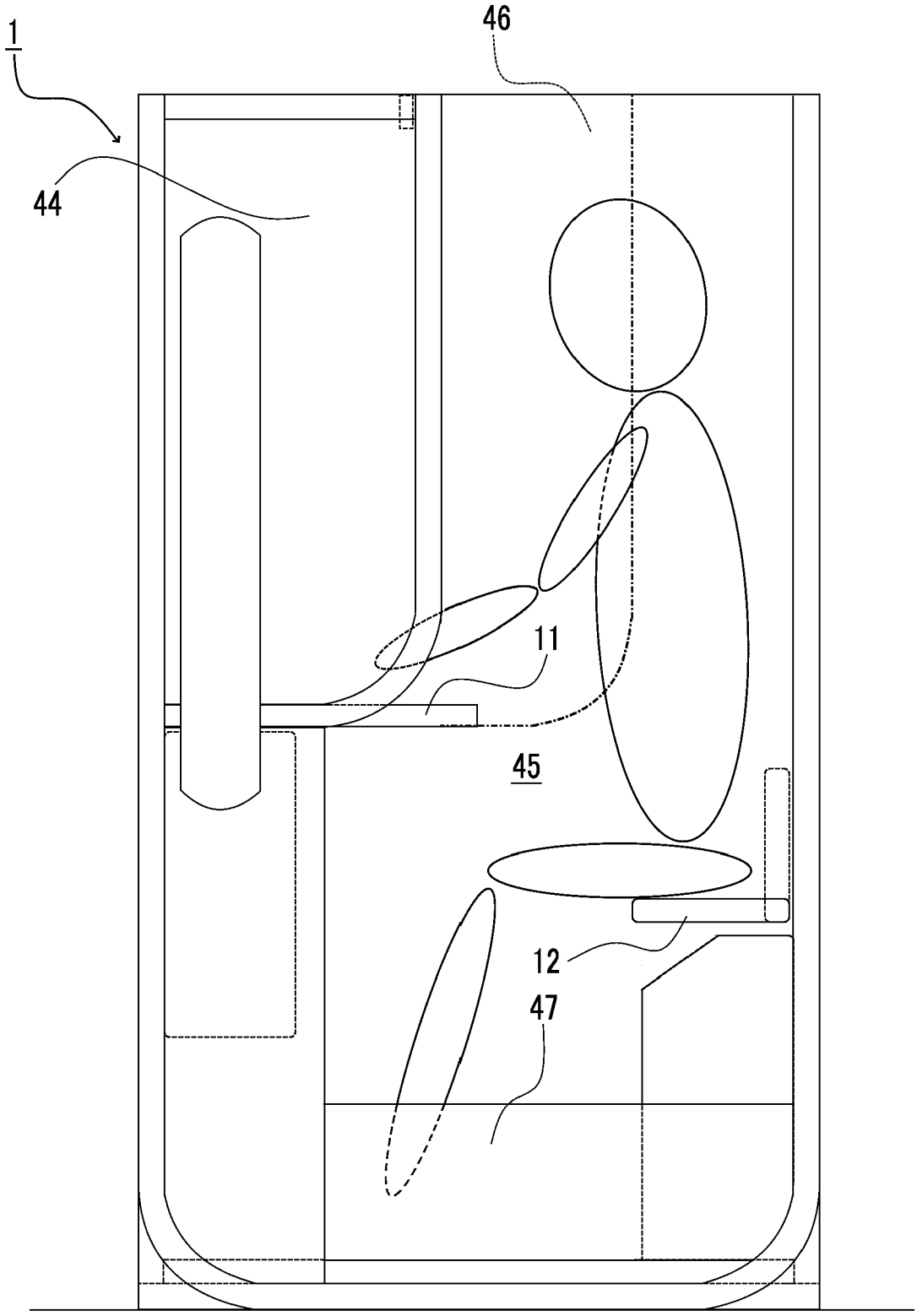
FIG. 9 is a front view showing the booth including a covering member for the opening portion.

FIG. 9 is a front view showing the booth 1 including a covering member 47 for the opening portion 45.

As shown in FIG. 9, the opening portion 45 of the booth 1 may be provided with the covering member 47 that makes the feet of the user invisible or difficult to see. The covering member 47 is formed of a non-translucent material and is provided at a height within a range in which entry and exit of the user through the opening portion 45 are not inhibited and the feet of the user are made invisible. In addition, the covering member 47 may be a roll curtain (roll screen).

(2.2) Gate Bar

Figure 10B:
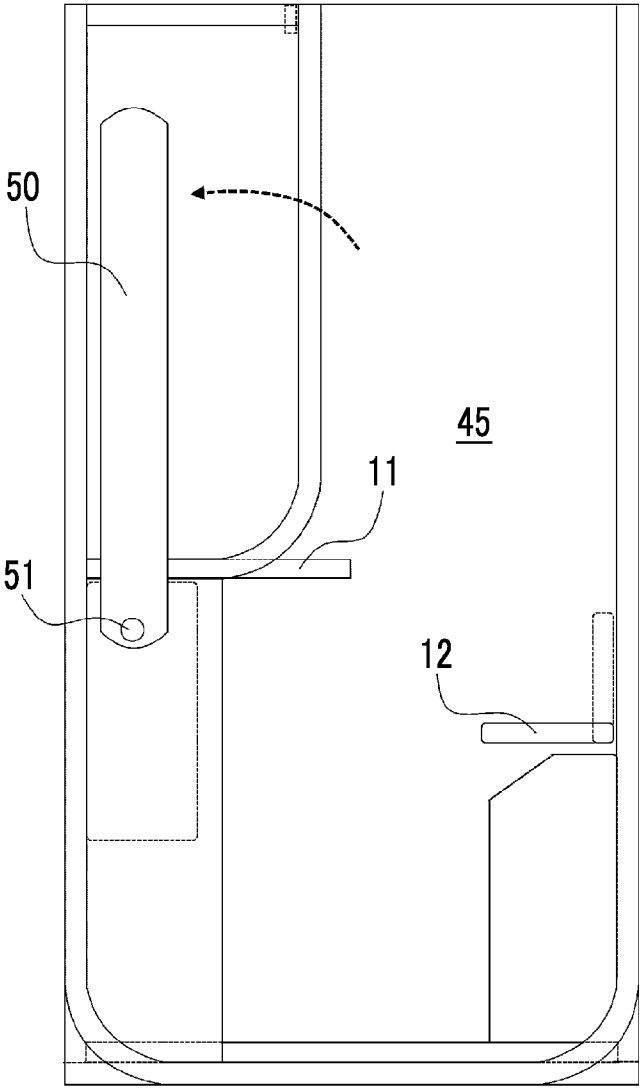
FIG. 10A is a front view of the booth which shows the opening portion with a gate bar closed and FIG. 10B is a front view of the booth which shows the opening portion with the gate bar opened.
Figure 10A:
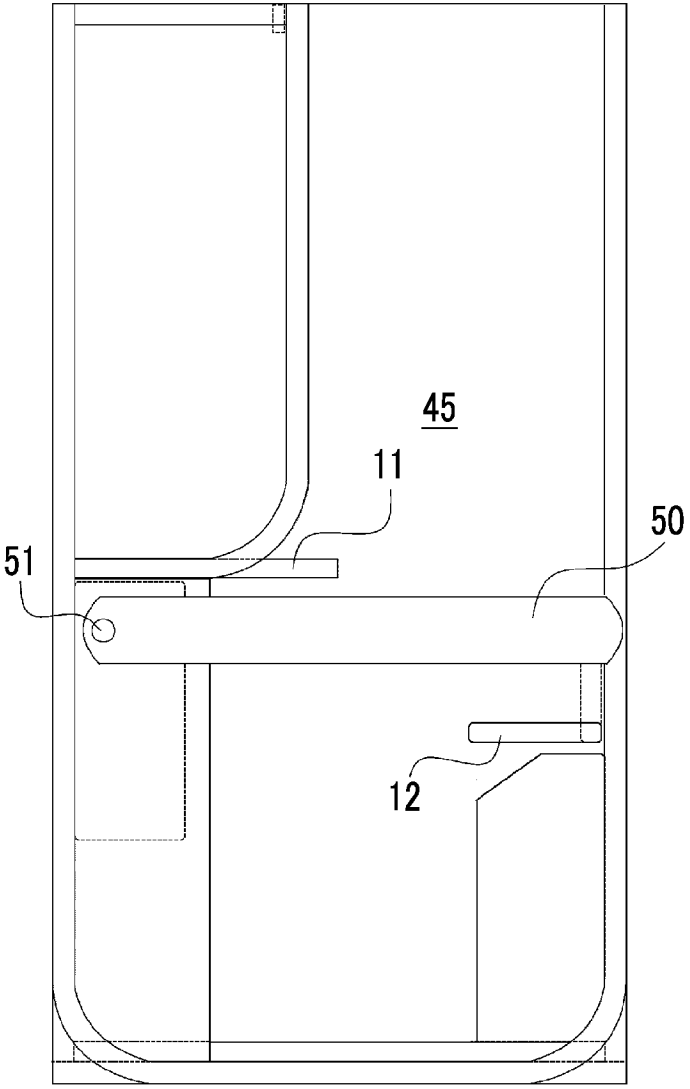
Figure 11A:
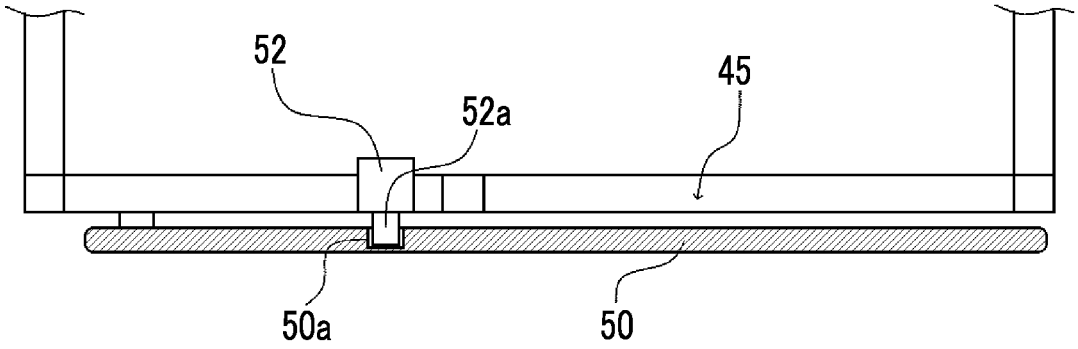
FIG. 11A is a schematic plan view showing an unlocked state of the gate bar and FIG. 11B is a schematic plan view showing a locked state.
Figure 11B:
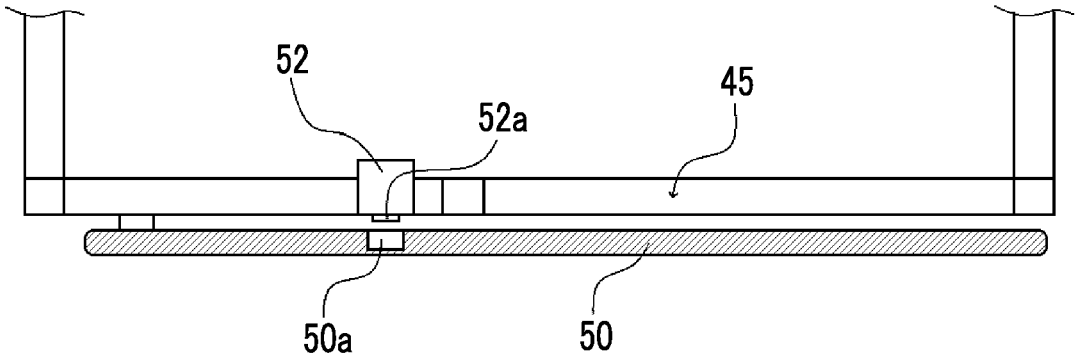

FIG. 10A is a front view of the booth 1 which shows the opening portion 45 with the gate bar 50 closed, FIG. 10B is a front view of the booth 1 which shows the opening portion 45 with the gate bar 50 opened, FIG. 11A is a schematic plan view showing an unlocked state of the gate bar 50, and FIG. 11B is a schematic plan view showing a locked state.

The gate bar 50 includes a rotation fulcrum 51 and is provided to be rotatable (refer to arrow in FIG. 10B) between a closing position as shown in FIG. 10A at which the opening portion 45 is closed such that entry from the outside is blocked and an opening position as shown in FIG. 10B at which the opening portion 45 is opened such that entry from the outside is allowed.

The gate bar 50 has a locking unit that can be unlocked by means of an unlocking key signal. Examples of the locking unit include an electromagnetic solenoid 52. A transition between an energized state and a non-energized state of the electromagnetic solenoid 52 and the movement of a movable iron core (not shown) cause the electromagnetic solenoid 52 to enter a locked state (shown in FIG. 11A) with a locking contact portion 52*a* fitted into a recess portion 50*a* of the gate bar 50 or an unlocked state (shown in FIG. 11B) with the locking contact portion 52*a* separated from the recess portion 50*a* of the gate bar 50.

A lock with the electromagnetic solenoid 52 is unlocked in a case where a smartphone is operated, the smartphone is placed in front of the electromagnetic solenoid 52, or a two-dimensional code pattern which is an example of a code displayed on the booth 1 is read, the smartphone being an example of a terminal with which the user makes a reservation for the booth 1 in advance.

Figure 12:
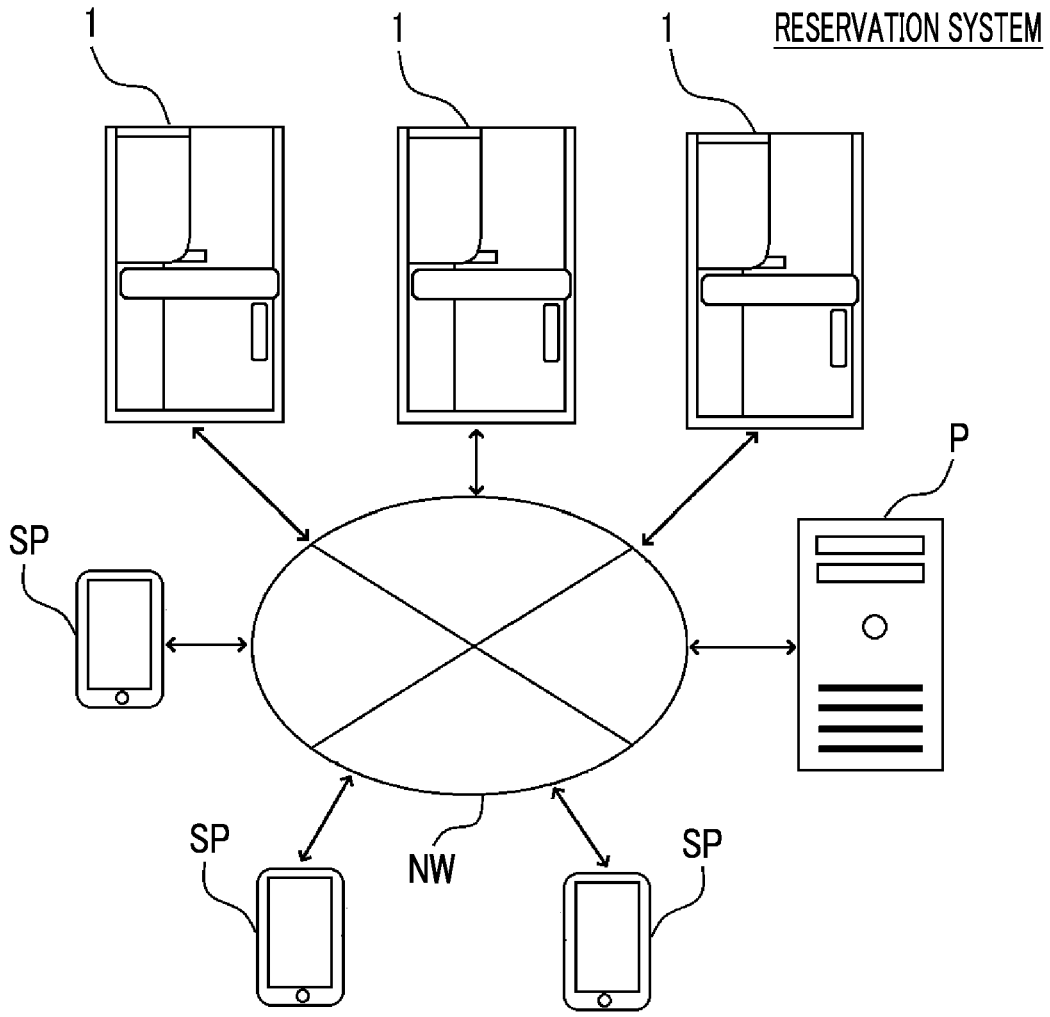
FIG. 12 is a diagram schematically showing an example of the overall configuration of a reservation system for the booth.

FIG. 12 is a diagram schematically showing an example of the overall configuration of a reservation system for the booth 1.

In the case of the present exemplary embodiment, an electronic key consisting of an unlocking key signal is used to lock and unlock the gate bar 50 of the booth 1, and the electronic key is stored in a portable reservation holder terminal SP. Although it will be assumed that the portable reservation holder terminal SP is a smartphone, examples of the portable reservation holder terminal SP include a so-called wearable terminal or a hearable terminal and a game terminal as long as the game terminal has a function of communicating with the Internet.

In a case where the reservation holder terminal SP is to be used as an electronic key, a reservation management server P transmits the electronic key to the reservation holder terminal SP after a reservation is confirmed. A user can unlock the electromagnetic solenoid 52 of the gate bar 50 by operating the reservation holder terminal SP that has received the electronic key or placing the reservation holder terminal SP in front of the electromagnetic solenoid 52. In addition, the user may unlock the electromagnetic solenoid 52 of the gate bar 50 by reading a two-dimensional code pattern displayed on the booth 1 and using the electronic key stored in the reservation holder terminal SP. In addition, authentication of a reservation holder, who is the user, may be used instead of a key and authentication of a reservation holder may be used as a means for supplementing the electronic key.

FIGS. 13A to 13E are views showing the use of the booth 1 together with the opening and closing of the gate bar 50.

Figure 13A:
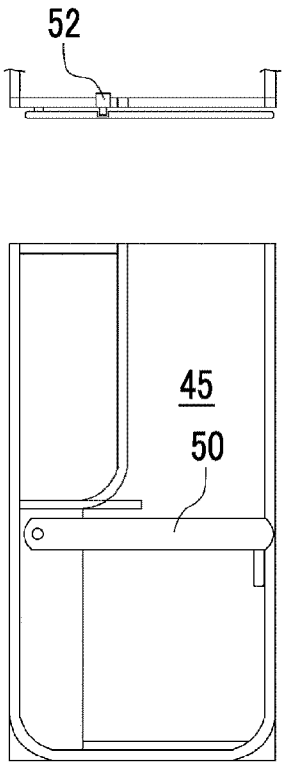
FIGS. 13A to 13E are views showing the use of the booth together with the opening and closing of the gate bar.
Figure 13B:
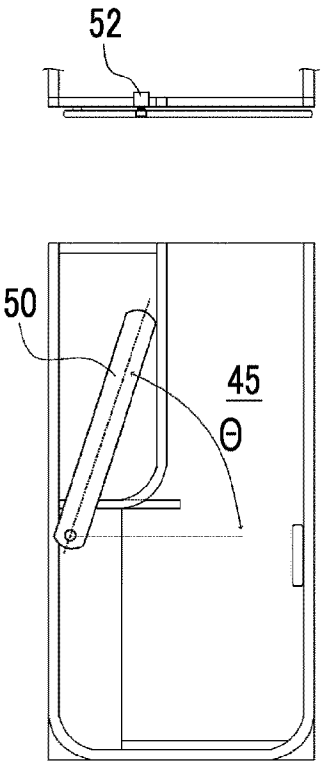

In the case of the booth 1 reserved for use, as shown in FIG. 13A, the gate bar 50 is positioned at the closing position, at which the opening portion 45 is closed such that entry from the outside is blocked, and is locked by the electromagnetic solenoid 52. Then, in a case where a user who has made a reservation for the booth 1 unlocks the lock with the electromagnetic solenoid 52 via the reservation holder terminal SP, the gate bar 50 rotates to the opening position and the opening portion 45 is opened such that entry from the outside is allowed as shown in FIG. 13B.

Note that, the gate bar 50 may be manually rotated by the user. In this case, for example, the gate bar 50 may be rotated approximately 70 degrees (refer to θ in FIG. 13B) to a position at which the gate bar 50 is inclined toward the opening portion 45 side with respect to the vertical line so that the opening portion 45 is opened. Accordingly, the gate bar 50 easily returns to the closing position due to the weight of the gate bar 50 in a case where the gate bar 50 is to be closed.

Figure 13C:
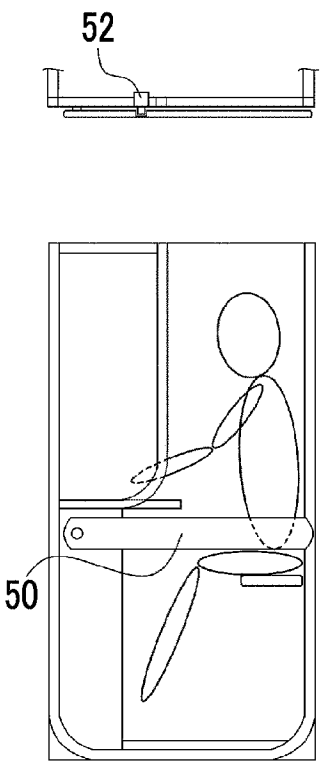

After the user enters the booth 1 through the opening portion 45, the user rotates the gate bar 50 to the closing position as shown in FIG. 13C and the electromagnetic solenoid 52 operates such that the gate bar 50 enters a locked state. Accordingly, it is possible to cause the opening portion 45 to enter a state where entry from the outside is blocked.

Figure 13D:
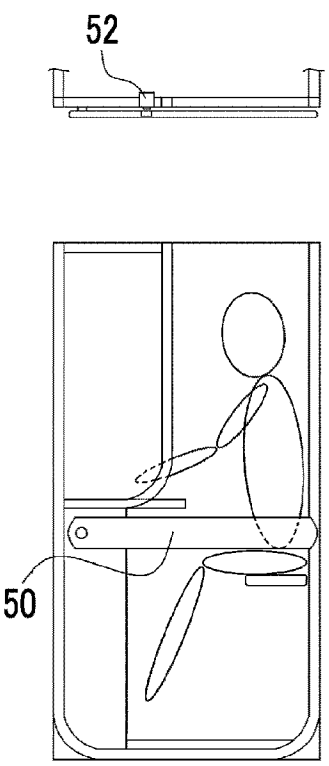
Figure 13E:
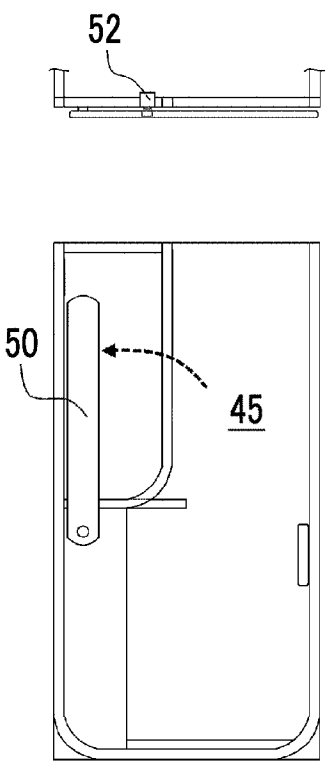

In a case where the user exits the booth 1, first, the user presses an unlocking button (not shown) disposed in the booth 1 to unlock the electromagnetic solenoid 52 as shown in FIG. 13D. Then, the user can exit after rotating (refer to arrow in FIG. 13E) the gate bar 50 to the opening position such that the opening portion 45 is opened as shown in FIG. 13E.

Modification Example

Figure 14B:
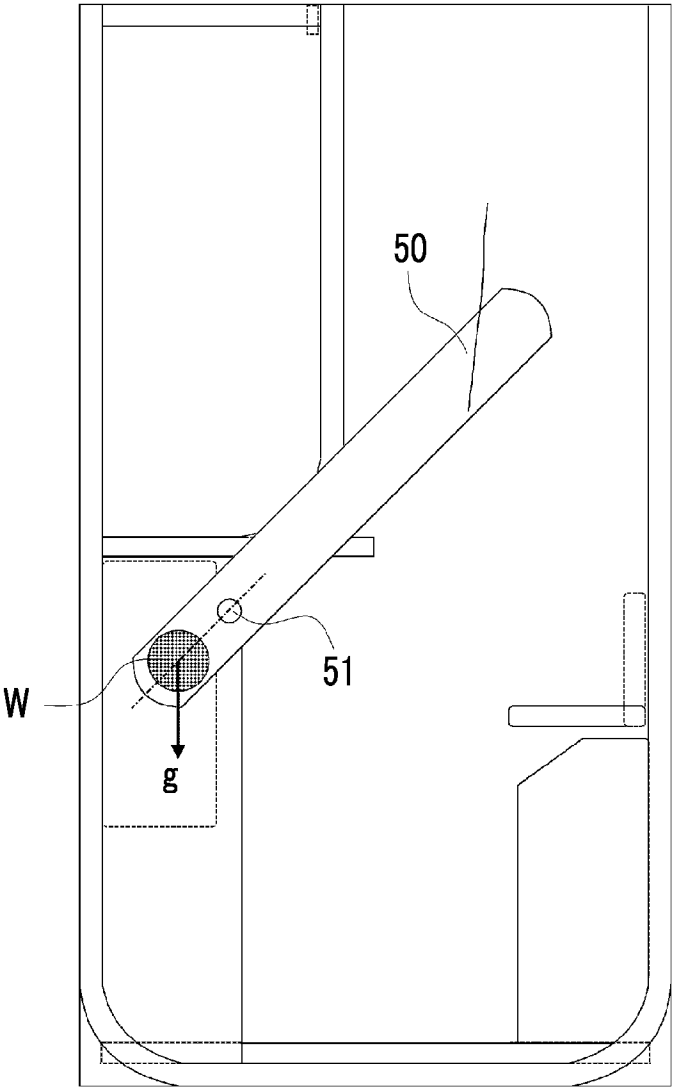
FIG. 14A is a front view of the booth including a gate bar according to a modification example and FIG. 14B is a view for describing how a weight acts in a case where the gate bar according to the modification example is rotated to an opening position.
Figure 14A:
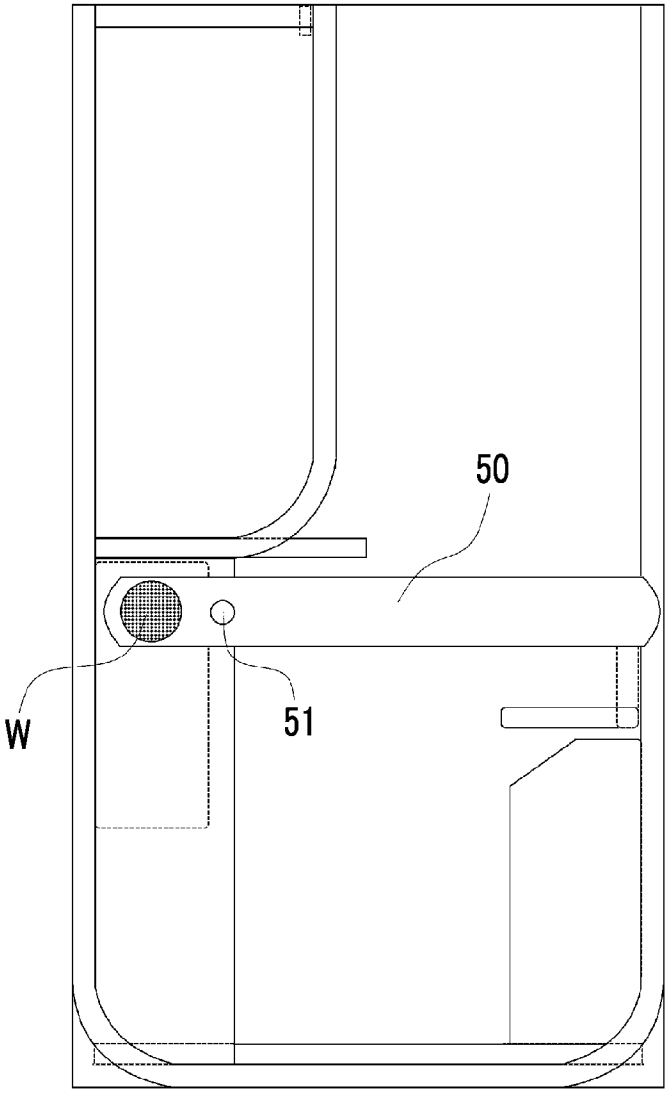

FIG. 14A is a front view of the booth 1 including the gate bar 50 according to a modification example, and FIG. 14B is a view for describing how a weight acts in a case where the gate bar 50 according to the modification example is rotated to the opening position.

As shown in FIG. 14A, the gate bar 50 according to the modification example includes a weight W provided at one end separated from the rotation fulcrum 51. A gravity force g of the weight W acts such that the gate bar 50 is rotated around the rotation fulcrum 51 in a counterclockwise direction in the drawings. Accordingly, in a case where the user manually rotates the gate bar 50 to the opening position as shown in FIG. 14B, the gate bar 50 may be rotated with a small force.

Second Exemplary Embodiment

Figure 15B:
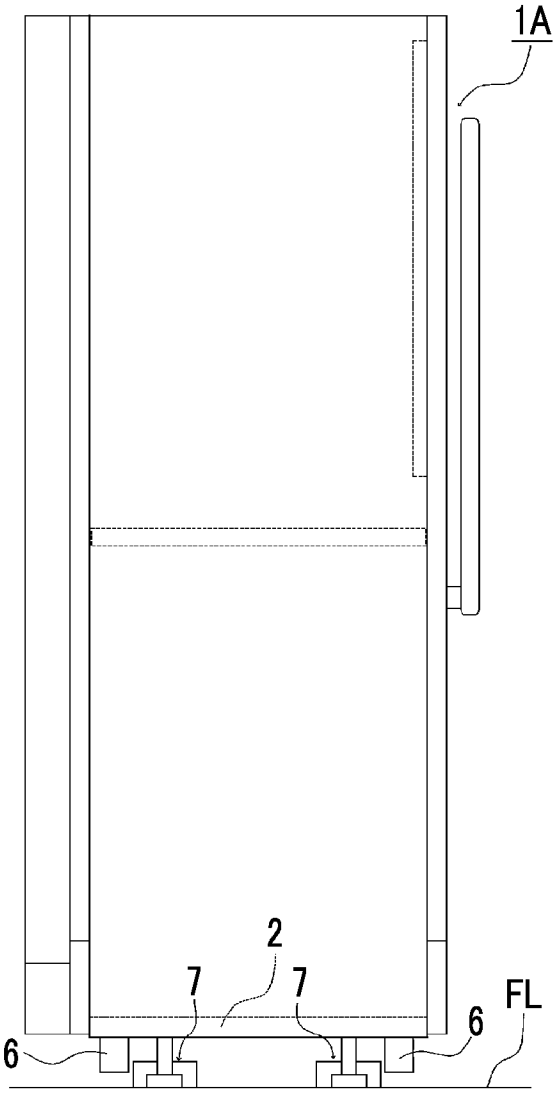
FIG. 15A is a front view of a booth according to a second exemplary embodiment with a viewpoint on the opening portion side and FIG. 15B is a side view of a second panel side.
Figure 15A:
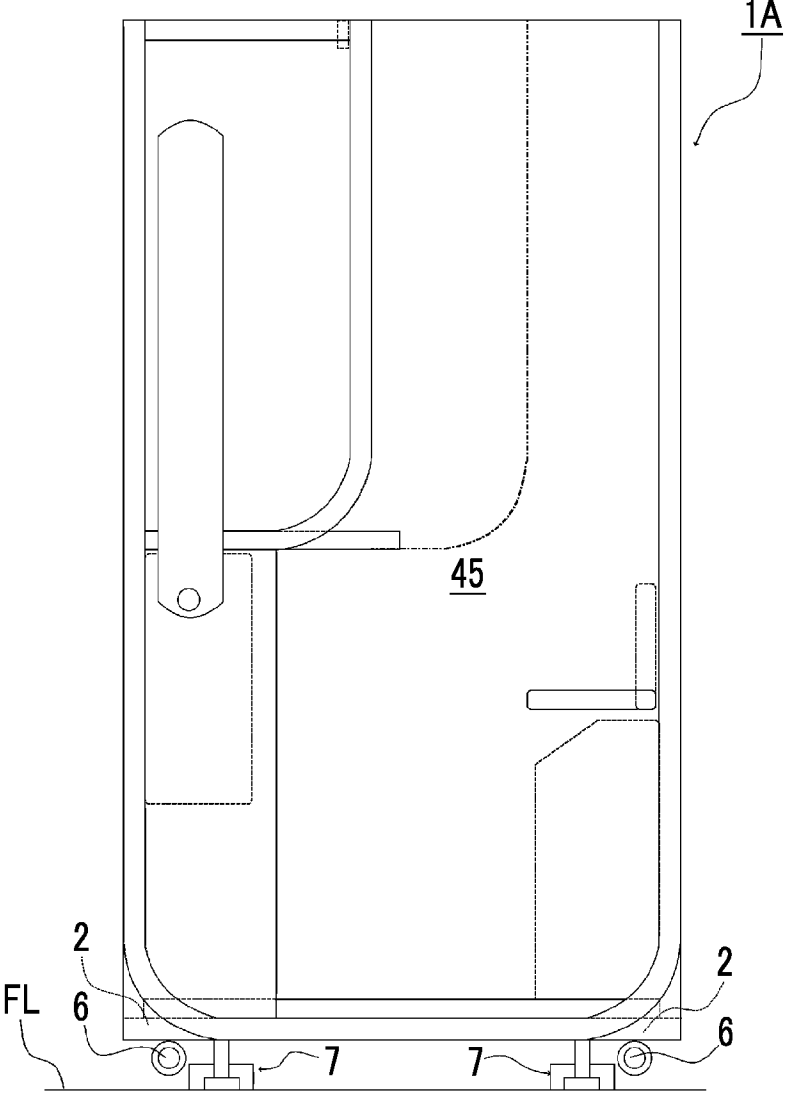
Figure 16B:
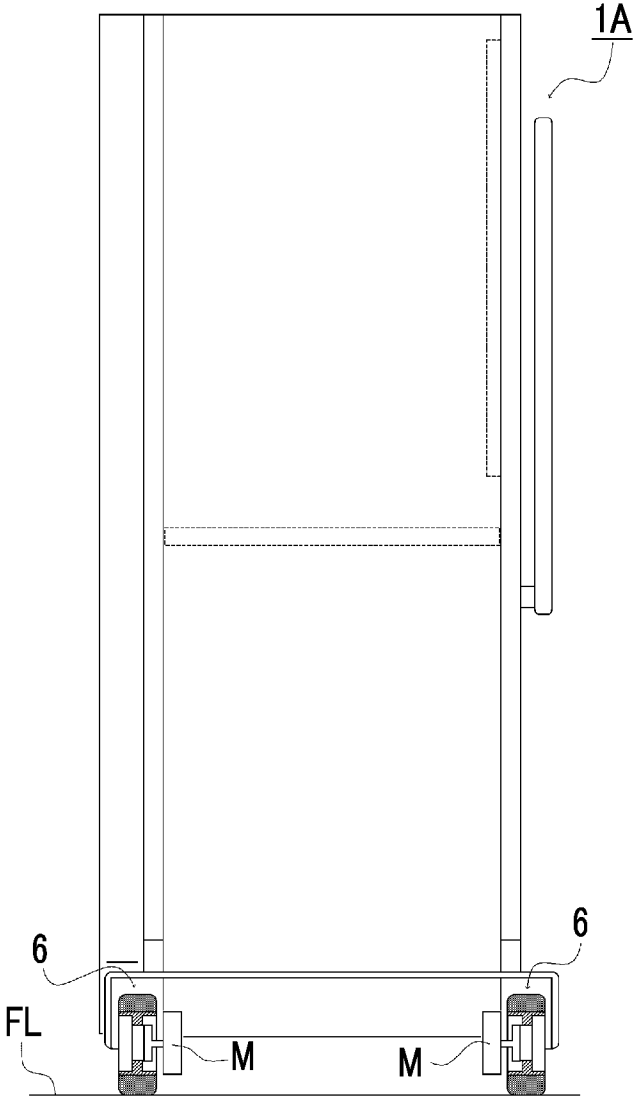
FIG. 16A is a front view of the booth according to a modification example with a viewpoint on the opening portion side and FIG. 16B is a side view of a second panel side of the booth according to the modification example.
Figure 16A:
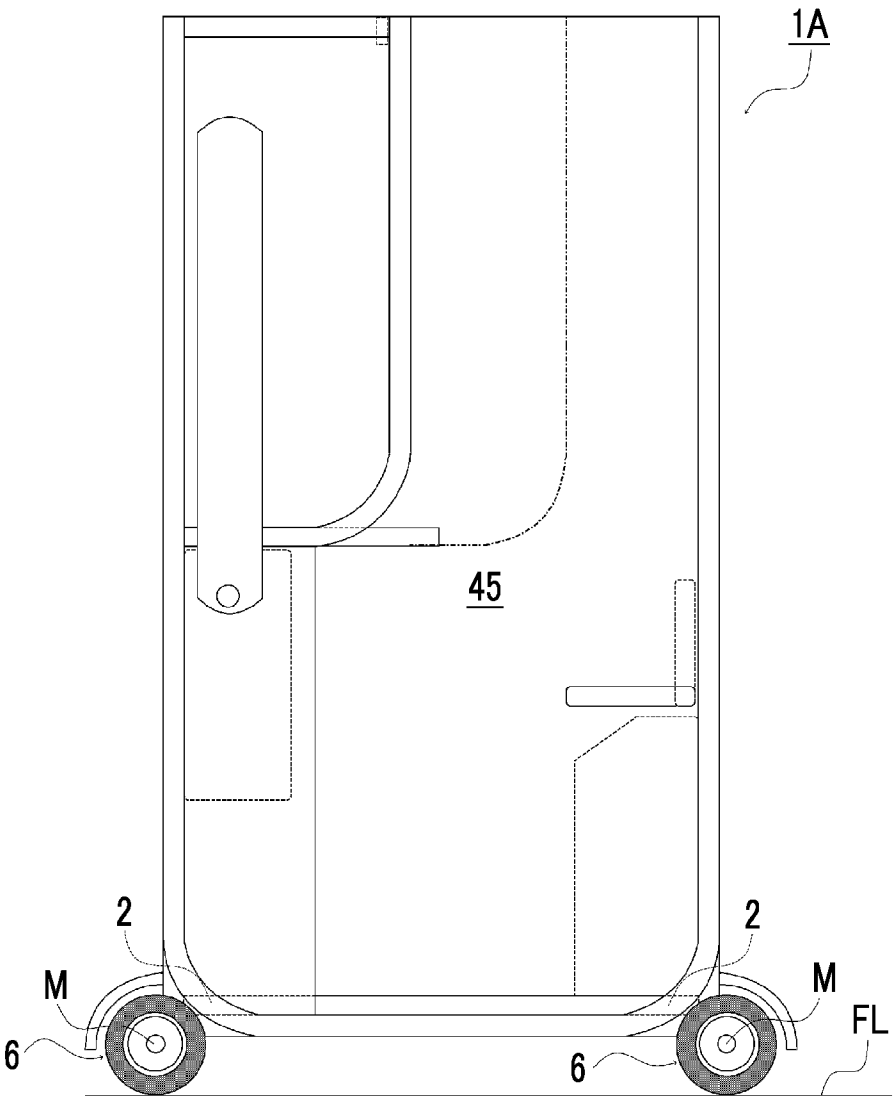

FIG. 15A is a front view of a booth 1A according to the present exemplary embodiment with a viewpoint on the opening portion 45 side and FIG. 15B is a side view of a second panel side. FIG. 16A is a front view of the booth 1A according to a modification example with a viewpoint on the opening portion 45 side and FIG. 16B is a side view of a second panel side of the booth 1A according to the modification example.

The booth 1A according to the present exemplary embodiment is different from the booth 1 according to the first exemplary embodiment in that casters 6 for movement are provided below the base portion 2. Therefore, the same components as components of the booth 1 according to the first exemplary embodiment are given the same reference numerals and detailed description of the components will be omitted.

As shown in FIGS. 15A and 15B, the booth 1A includes the casters 6 that are provided below the base portion 2 and fixing tools 7 that are provided below the base portion 2 and provided in the vicinity of the casters 6. The casters 6 are provided at four lower corners of the base portion 2. In a case where the booth 1A assembled at a factory or the like is to be installed at an installation place, the booth 1A is carried on a cargo bed of a truck or the like and at the installation place, the booth 1A is moved via the casters 6 to be installed on an installation surface.

The fixing tools 7 are configured to be adjustable in height and the fixing tools 7 fix the booth 1A to the installation surface FL to be immovable with the casters 6 raised from the installation surface FL between the installation surface FL and the base portion 2.

Modification Example

As shown in FIGS. 16A and 16B, in-wheel motors M that rotationally drive the casters 6 may be incorporated into the casters 6. In a case where the in-wheel motors M are incorporated, the rotation and orientation of the casters 6 can be controlled so that movement at an installation place is facilitated.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A booth that has an opening through which a user enters and exits the booth and a desk and a chair installed in a space surrounded by a floor and a side wall, the booth comprising:

a movable sound insulation member that is installable to enclose the user in a case where the user is below a top portion of the booth while being in the booth, wherein the sound insulation member comprises a plurality of unit panels that are foldably connected to each other, is stored in a storage region defined by the side wall and a sound absorption panel provided at an inner surface of the space at an opening position at which an upper side of the space is opened, and the sound insulation member covers a portion of the opening.

2. The booth according to claim 1, wherein the sound insulation member has a light-transmitting property.

3. The booth according to claim 1, further comprising:

a sliding door that covers the opening.

4. The booth according to claim 3, wherein the door covers a region that is on an upper side of the opening and is higher than the desk.

5. The booth according to claim 1, wherein the opening is further provided with a covering member that makes feet of the user invisible or difficult to see.

6. The booth according to claim 1, wherein a gate bar that is opened and closed such that the space becomes enterable for the user is disposed at the opening.

7. The booth according to claim 6, wherein the gate bar includes a locking unit that is unlockable by using an unlocking key signal.

8. The booth according to claim 7, wherein the gate bar is unlockable and rotatable such that the opening is opened by rotating and unlocking the gate bar.

9. The booth according to claim 8, wherein the gate bar is rotatable to a first position at which the gate bar is inclined toward an opening side with respect to a vertical line so that the opening is opened.

10. The booth according to claim 7, wherein, the gate bar is rotatable to a first position such that the opening is closed and is locked by the locking unit.

11. The booth according to claim 7, wherein the gate bar is rotatable from a second position to a first position such that the opening is opened and is unlocked by the locking unit.

12. The booth according to claim 6, wherein the gate bar includes a weight that reduces a weight of the gate bar in a rotation direction.

13. The booth according to claim 1, wherein a seat surface of the chair is foldable and the seat surface becomes sittable by being unfolded to have a length and a height such that a rear part of a femoral region of the user is not pressed.

14. The booth according to claim 1, further comprising:

a power source that supplies power to a device installed in the booth, wherein an outer periphery of the power source is covered with a heat insulating member.

15. The booth according to claim 1, wherein the floor is provided with a caster for movement.

16. The booth according to claim 15, wherein the caster includes an in-wheel motor that rotationally drives the caster.

17. The booth according to claim 1, wherein the sound insulation member is movable to a closing position at which the sound insulation member covers a portion of the opening, the sound insulation member is stored in the storage region which is entirely at the side wall, and the booth further comprises a guide groove through which is the sound insulation member is pulled out from the storage region to slide across from the side wall to an opposite side wall so as to cover the user on two sides.

18. The booth according to claim 1, wherein the the sound insulation member is transparent.

* * * * *